US012305533B2

(12) United States Patent
Gemme et al.

(10) Patent No.: US 12,305,533 B2
(45) Date of Patent: May 20, 2025

(54) TURBINE ROTOR DOVETAIL STRUCTURE WITH SPLINES

(71) Applicant: Pratt & Whitney Canada Corp., Longueuil (CA)

(72) Inventors: Francis Gemme, Sainte-Julie (CA); Othmane Leghzaouni, Boucherville (CA); Robert Huszar, Saint-Bruno-de-Montarville (CA); Daniel Lecuyer, St-Bruno (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 18/340,601

(22) Filed: Jun. 23, 2023

(65) Prior Publication Data

US 2024/0426221 A1 Dec. 26, 2024

(51) Int. Cl.
*F01D 5/30* (2006.01)

(52) U.S. Cl.
CPC ..... *F01D 5/3007* (2013.01); *F01D 5/30* (2013.01)

(58) Field of Classification Search
CPC ..... F01D 5/3007; F01D 5/30
See application file for complete search history.

(56) References Cited

U.S. PATENT DOCUMENTS 4,191,509 A * 3/1980 Leonardi ..... F01D 5/3007 416/241 B
5,110,262 A * 5/1992 Evans ..... F01D 5/3007 416/219 R
5,147,180 A * 9/1992 Johnson ..... F01D 5/3007 416/223 A
5,160,242 A 11/1992 Brown
5,176,500 A 1/1993 Heinig
5,554,005 A 9/1996 Nguyen
6,183,202 B1 2/2001 Ganshaw
8,047,796 B2 11/2011 Riaz et al.
9,739,158 B2 8/2017 Rivers et al.
9,932,834 B2 4/2018 Hough et al.
10,287,898 B2 5/2019 Bluck
11,578,607 B2 2/2023 Lecuyer et al.
11,753,950 B2 9/2023 Pernleitner et al.
11,933,192 B2 * 3/2024 Joo ..... F01D 9/02
(Continued)

FOREIGN PATENT DOCUMENTS

CN 118391102 A 7/2024
EP 3575556 A1 12/2019
(Continued)

OTHER PUBLICATIONS

Extended European Search Report for EP Application No. 24183977.8, dated Nov. 6, 2024, pp. 1-10.

*Primary Examiner* — David E Sosnowski
*Assistant Examiner* — Theodore C Ribadeneyra
(74) *Attorney, Agent, or Firm* — CANTOR COLBURN LLP

(57) ABSTRACT

A fir tree structure is provided and includes a part extending radially inwardly from a rotating part and having an inward taper. The part has a spline profile forming fixing lobes and necks, which are interleaved with the fixing lobes. The spline profile has constantly changing radii of curvature characterized in that the radii of curvature are relatively reduced in high stress locations and relatively increased in low stress locations.

19 Claims, 6 Drawing Sheets

(56) References Cited

U.S. PATENT DOCUMENTS

| | | | | |
|---|---|---|---|---|
| 12,152,504 | B2 | 11/2024 | Pernleitner et al. | |
| 2005/0175461 | A1 | 8/2005 | Lagrange et al. | |
| 2008/0050238 | A1 | 2/2008 | Durocher et al. | |
| 2008/0206060 | A1* | 8/2008 | Roberts ..... | B23H 9/10<br>29/889.7 |
| 2009/0022591 | A1 | 1/2009 | Mujezinovic et al. | |
| 2016/0333707 | A1 | 11/2016 | Holzhaeuser et al. | |
| 2023/0046019 | A1 | 2/2023 | Bayer et al. | |
| 2024/0352861 | A1 | 10/2024 | Place et al. | |

FOREIGN PATENT DOCUMENTS

| | | | |
|---|---|---|---|
| GB | 2345943 | B | 7/2003 |
| WO | 2016195689 | A1 | 12/2016 |

* cited by examiner

TURBINE ROTOR DOVETAIL STRUCTURE WITH SPLINES

BACKGROUND

The present disclosure relates turbines and, more particularly, to a dovetail structure of a turbine blade with splines forming a fixing profile.

A turbine is used to generate power for propulsion, in some cases, by turning propellors, fans or helicopter blades through a gearbox. In some instances, the gearbox output is used to power electrical generators. In a gas turbine engine, fuel and compressed oxygen are combusted in a combustor to produce a high-temperature and high-pressure fluid. This fluid enters a turbine and interacts with rows or stages of turbine blades and vanes. This interaction causes the stages of turbine blades to rotate a rotor. The rotor rotation drives a compressor to compress the oxygen for the combustor and, as noted above, can be used to drive operations of a generator to produce electricity or for propulsion.

BRIEF DESCRIPTION

According to an aspect of the disclosure, a fir tree structure is provided and includes a part extending radially inwardly from a rotating part and having an inward taper. The part has a spline profile forming fixing lobes and necks, which are interleaved with the fixing lobes. The spline profile has constantly changing radii of curvature characterized in that the radii of curvature are relatively reduced in high stress locations and relatively increased in low stress locations.

In accordance with additional or alternative embodiments, the fixing lobes include an inboard fixing lobe and an outboard fixing lobe, which is wider than the inboard fixing lobe and the fixing necks include an inboard fixing neck, which is inboard from the outboard fixing lobe, and an outboard fixing neck, which is outboard of the outboard fixing lobe and wider than the inboard fixing neck.

In accordance with additional or alternative embodiments, the spline profile includes non-curvature portions at transitions between the fixing lobes and the fixing necks.

In accordance with additional or alternative embodiments, a plot of curvature along the outboard fixing neck exhibits a first hump, a second hump of significantly greater amplitude than the first hump and a third hump of slightly greater amplitude than the second hump.

In accordance with additional or alternative embodiments, the plot of the curvature along the outboard fixing neck is taken from a starting point at an outboard portion of the outboard fixing neck to an ending point at an inboard portion of the outboard fixing neck.

In accordance with additional or alternative embodiments, the second hump is interposed between the first and third humps.

In accordance with additional or alternative embodiments, the first, second and third humps have a similar pitch.

In accordance with additional or alternative embodiments, a plot of curvature along the inboard fixing neck exhibits a hump, a trough and an inflexion point between the hump and the trough that is closer to the hump.

In accordance with additional or alternative embodiments, the plot of the curvature along the outboard fixing neck is taken from a starting point at an outboard portion of the inboard fixing neck to an ending point at an inboard portion of the inboard fixing neck According to an aspect of the disclosure, a fir tree structure of a turbine blade is provided and includes a blade part extending radially inwardly from the turbine blade and having an inward taper. The blade part has a spline profile forming blade fixing lobes and blade fixing necks, which are interleaved with the blade fixing lobes. The spline profile has constantly changing radii of curvature characterized in that the radii of curvature are relatively reduced in high stress locations and relatively increased in low stress locations.

In accordance with additional or alternative embodiments, the blade fixing lobes include an inboard blade fixing lobe and an outboard blade fixing lobe, which is wider than the inboard blade fixing lobe and the blade fixing necks include an inboard blade fixing neck, which is inboard from the outboard blade fixing lobe, and an outboard blade fixing neck, which is outboard of the outboard blade fixing lobe and wider than the inboard blade fixing neck.

In accordance with additional or alternative embodiments, the spline profile includes non-curvature portions at transitions between the blade fixing lobes and the blade fixing necks.

In accordance with additional or alternative embodiments, a plot of curvature along the outboard blade fixing neck exhibits a first hump, a second hump of significantly greater amplitude than the first hump and a third hump of slightly greater amplitude than the second hump.

In accordance with additional or alternative embodiments, the plot of the curvature along the outboard blade fixing neck is taken from a starting point at an outboard portion of the outboard blade fixing neck to an ending point at an inboard portion of the outboard blade fixing neck.

In accordance with additional or alternative embodiments, the second hump is interposed between the first and third humps.

In accordance with additional or alternative embodiments, the first, second and third humps have a similar pitch.

In accordance with additional or alternative embodiments, a plot of curvature along the inboard blade fixing neck exhibits a hump, a trough and an inflexion point between the hump and the trough that is closer to the hump.

In accordance with additional or alternative embodiments, the plot of the curvature along the outboard blade fixing neck is taken from a starting point at an outboard portion of the inboard blade fixing neck to an ending point at an inboard portion of the inboard blade fixing neck.

According to an aspect of the disclosure, a method of forming a fir tree structure of a turbine blade is provided. The method includes providing a part extending radially inwardly from the turbine blade and having an inward taper and forming the part to have a spline profile forming fixing lobes and fixing necks, which are interleaved with the fixing lobes. The forming of the part includes identifying high and low stress locations of the part and designing the spline profile to have constantly changing radii of curvature characterized in that the radii of curvature are relatively reduced in the high stress locations and relatively increased in the low stress locations.

In accordance with additional or alternative embodiments, the part includes a blade part.

In accordance with additional or alternative embodiments, the forming of the part includes machining.

Additional features and advantages are realized through the techniques of the present disclosure. Other embodiments and aspects of the disclosure are described in detail herein and are considered a part of the claimed technical concept.

For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
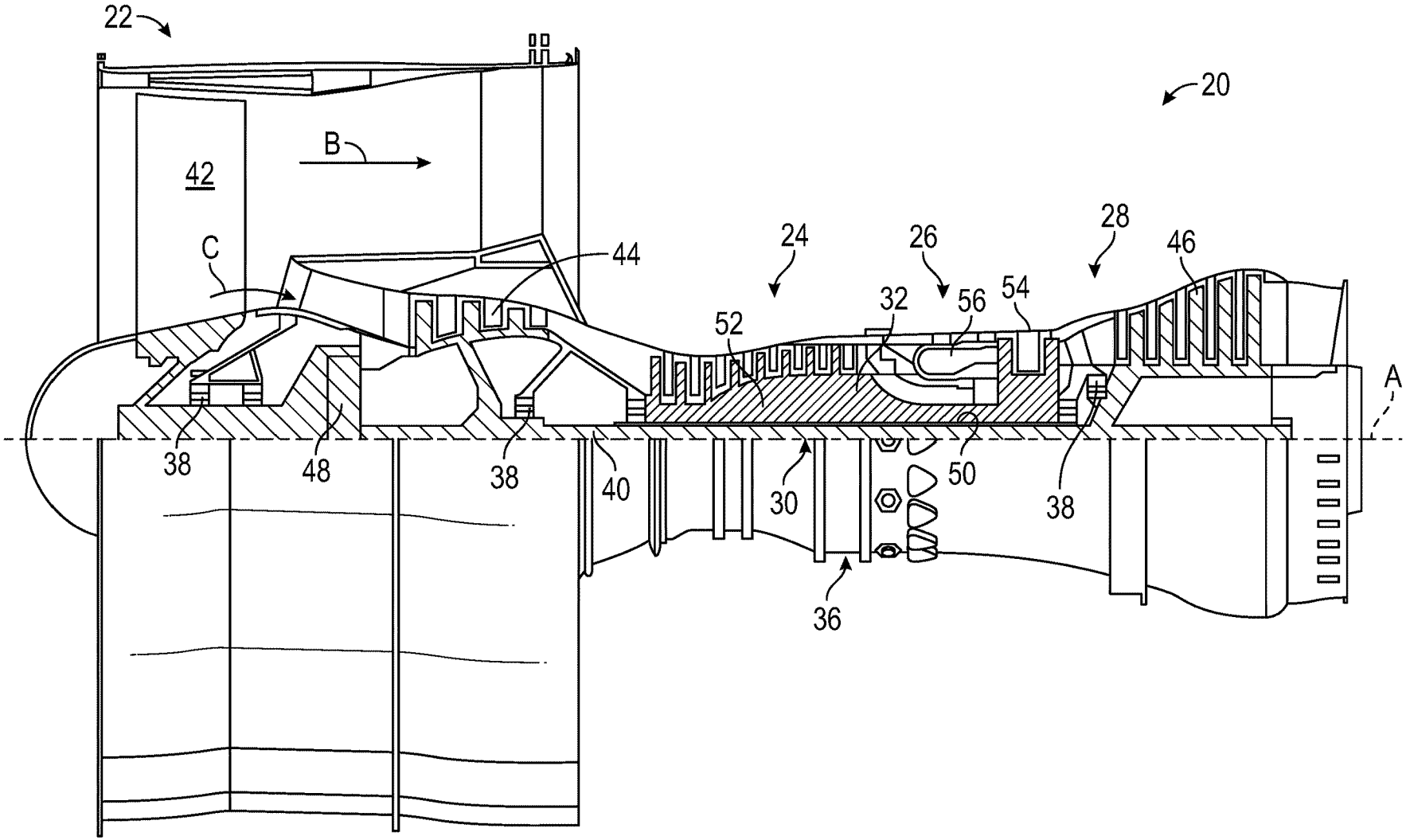
FIG. 1 is a partial cross-sectional view of a portion of an exemplary gas turbine engine in accordance with embodiments.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
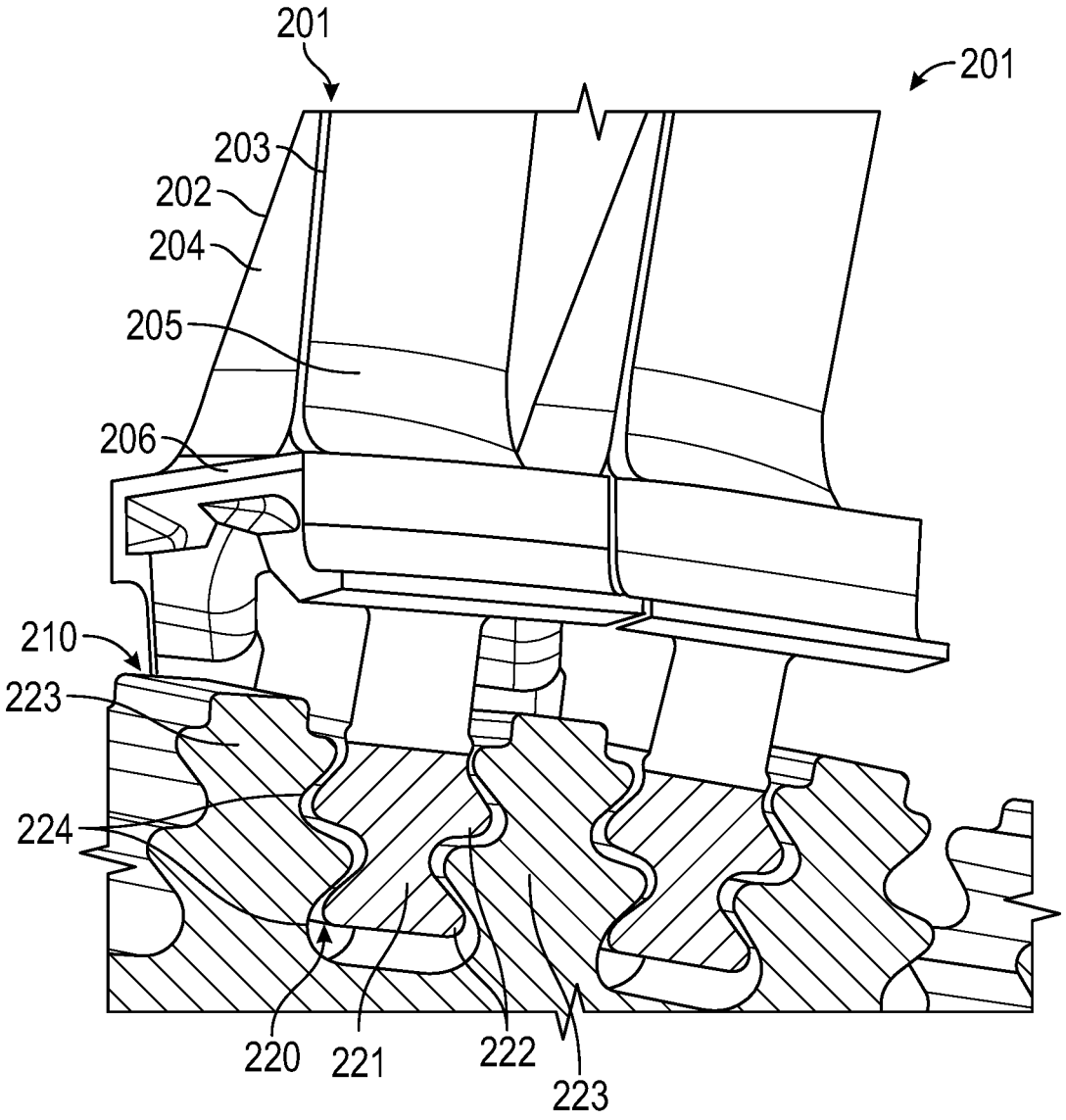
FIG. 2 is a perspective view of a fir tree structure of a turbine blade in accordance with embodiments.
Figure 3:
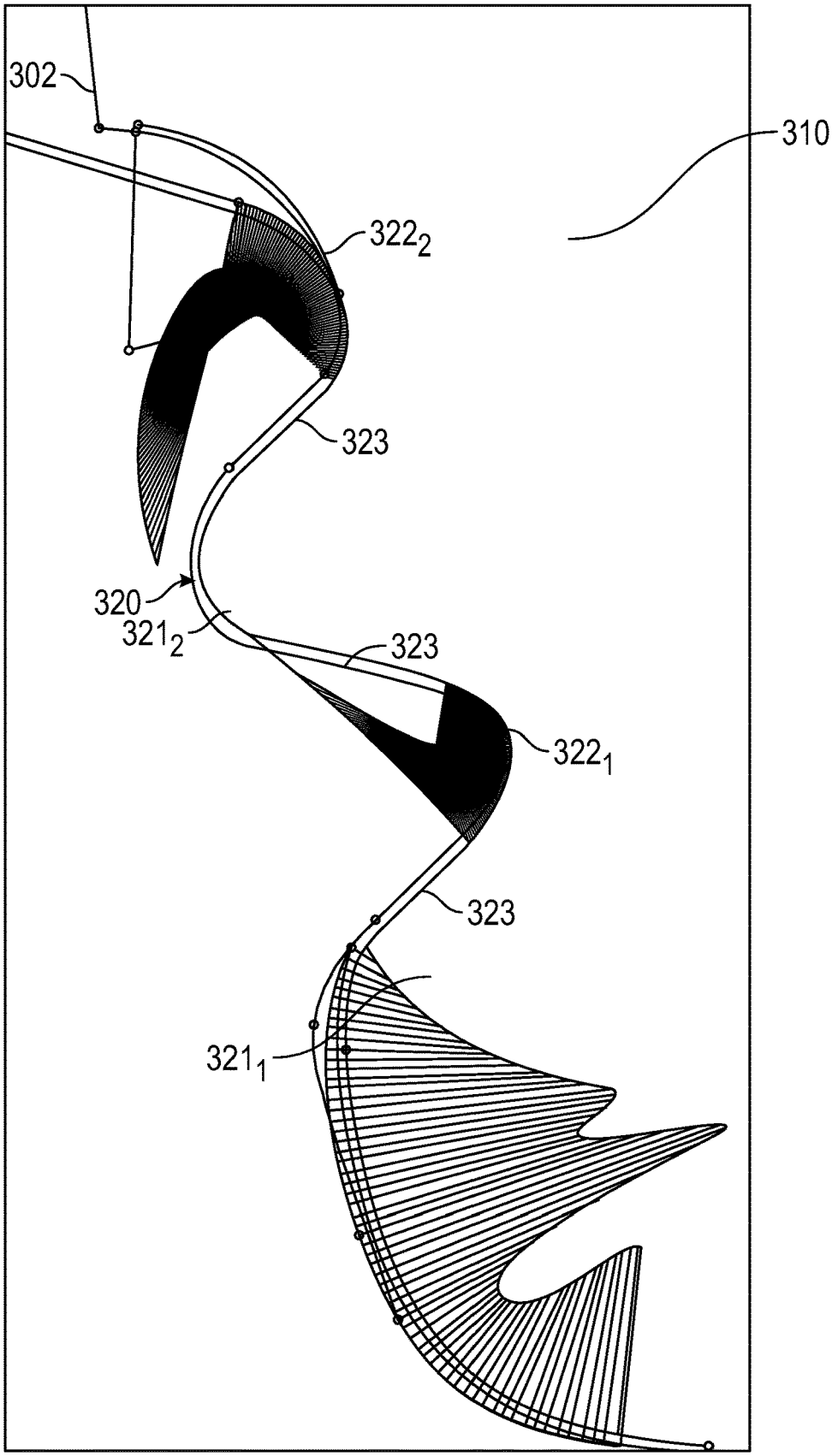
FIG. 3 is a graphical depiction of a spline profile of a fir tree structure in accordance with embodiments.

With continued reference to FIG. 1 and with additional reference to FIG. 2, multiple stages of rotating parts, such as turbine blades 201, are provided to interact with working fluid within the turbine section 28 of FIG. 1 to in turn drive rotation of a rotor (i.e., the high-speed spool 30 of FIG. 1). Each of the turbine blades 201 typically has an airfoil shape with opposed leading and trailing edges 202 and 203 and opposed pressure and suction surfaces 204 and 205 that extend radially outwardly from a root 206 to a tip. At the root 206, each of the turbine blades 201 is secured to a rotor assembly 210 by a fir tree structure 220. For each turbine blade 201, the fir tree structure 220 includes a blade part 221, which extends radially inwardly from the root 206 and which has an inward taper with outwardly extending lobes 222, and rotor assembly parts 223. The rotor assembly parts 223 are provided on either side of the blade part 221 and have outward tapers and recesses 224 that receive the outwardly extending lobes 222. When the turbine blades 201 and the rotor rotate, centrifugal force acts on the fir tree structure 220 and causes radially outward facing surfaces of the outwardly extending lobes 222 to impinge upon radially inward facing surfaces of the recesses 224 to thereby secure the rotor blades 201 in place.

In conventional turbines, the curves of the outward projections and the recesses of a typical fir tree structure have simple geometries and uniform radii of curvatures over extended surface areas. In practice, such simple geometries and uniform curvatures were found to lead to non-optimal mechanical interactions and stress concentrations.

Therefore, a need exists for fir tree structures of turbine blades that have improved mechanical interactions and reduced or eliminated stress concentrations.

Thus, as will be discussed below, a fir tree structure of a turbine blade is provided with varying spline profiles. This fir tree structure can be used with gas turbine engines, such as the gas turbine engine 20 of FIG. 1, as well as other types of turbine engines, such as non-fan or turbo-shaft engines (i.e., where a gearbox is powered, transmitting power to helicopter rotors and secondly to a gearbox driving a propeller). In any case, the fir tree structure is enabled by machining processes, such as electro-discharge machining (EDM), milling, laser cutting, etc. The varying spline profiles result in the fir tree structure being optimized for stress across varying operational ranges. During design phases, a best-circular fixing process is optimized by replacing circular radii of the fir tree structure with splines that are adjusted to minimize peak stresses. The splines can be symmetrical on both sides of the fir tree structure or they can be different from one another (i.e., a profile under the pressure side rail can be different in shape from the profile under the suction side rail). While optimal shapes of the splines can be at least slightly different in each case to account for differences between exact stress patterns, which varies depending on lobe shapes, stiffness, broach angles, airfoil and pocket shapes, etc., spline radii will generally be reduced in areas of highest stress and increased where stresses are lower.

With reference to FIG. 3, FIGS. 4 and 5 and FIGS. 6 and 7, a fir tree structure 301 of a turbine blade 302 is provided and includes a blade part 310 or a disc part. The blade part 310 is configured to extend radially inwardly from a root of the turbine blade 302 and that has an inward taper with decreasing radial position. The blade part 310 has a spline profile 320 forming blade fixing lobes 321 and blade fixing necks 322, which are interleaved with the blade fixing lobes 321. The spline profile 320 has constantly changing radii of curvature characterized in that the radii of curvature are relatively reduced in high stress locations and relatively increased in low stress locations. The blade fixing lobes 321 include an inboard blade fixing lobe $\mathbf{321}_1$ and an outboard blade fixing lobe $\mathbf{321}_2$, which is wider than the inboard blade fixing lobe $\mathbf{321}_1$. The blade fixing necks 322 include an inboard blade fixing neck $\mathbf{322}_1$, which is inboard from the outboard blade fixing lobe $\mathbf{321}_2$, and an outboard blade fixing neck $\mathbf{322}_2$, which is outboard of the outboard blade fixing lobe $\mathbf{321}_2$ and wider than the inboard blade fixing neck $\mathbf{322}_1$. The spline profile 320 further includes non-curvature (i.e., flat) portions at transitions 323 between the blade fixing lobes 321 and the blade fixing necks 322.

Figure 4:
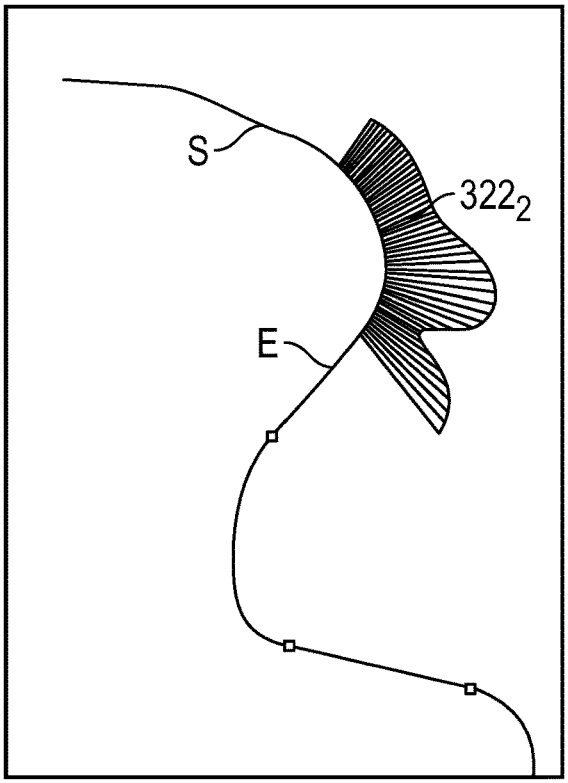
FIG. 4 is a graphical depiction of curvature (1/radii) of a portion of a spline profile of a fir tree structure in accordance with embodiments.
Figure 5:
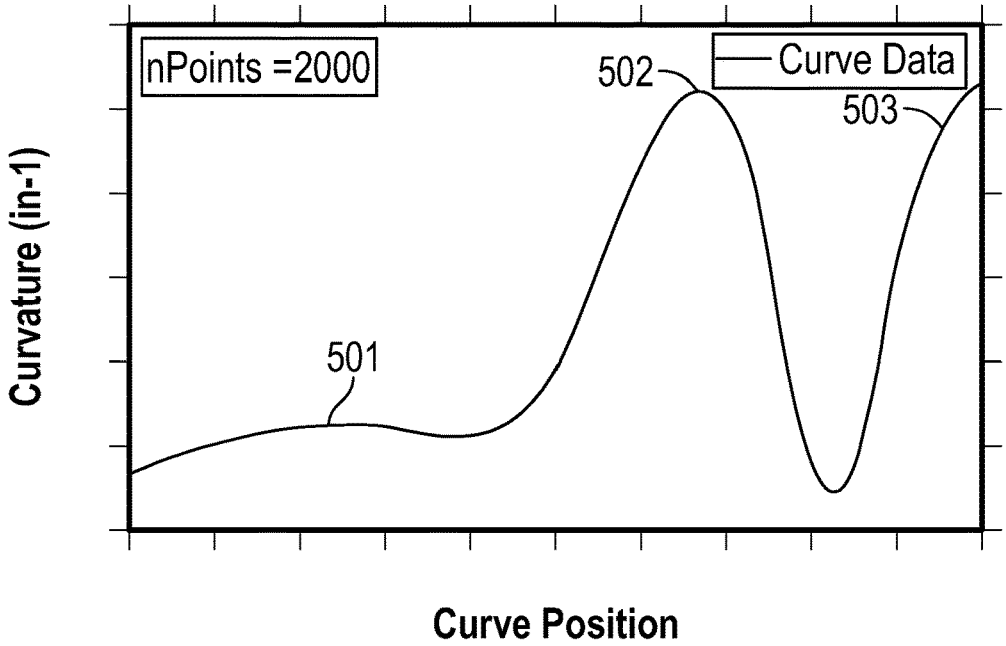
FIG. 5 is a plot of the curvature (1/radii) of FIG. 4 in accordance with embodiments.

As shown in FIGS. 4 and 5, a plot of curvature, or the inverse of the radii, along the outboard blade fixing neck $\mathbf{322}_2$ exhibits a first hump 501, a second hump 502 of significantly greater amplitude than the first hump 501 and a third hump 503 of slightly greater amplitude than the second hump 502. This plot can be taken from a starting point S at an outboard portion of the outboard blade fixing neck $\mathbf{322}_2$ to an ending point E at an inboard portion of the outboard blade fixing neck $\mathbf{322}_2$. In accordance with embodiments, the second hump 502 is interposed between the first and third humps 501 and 503 and the first, second and third humps 501, 502 and 503 can have a similar pitch.

Figure 6:
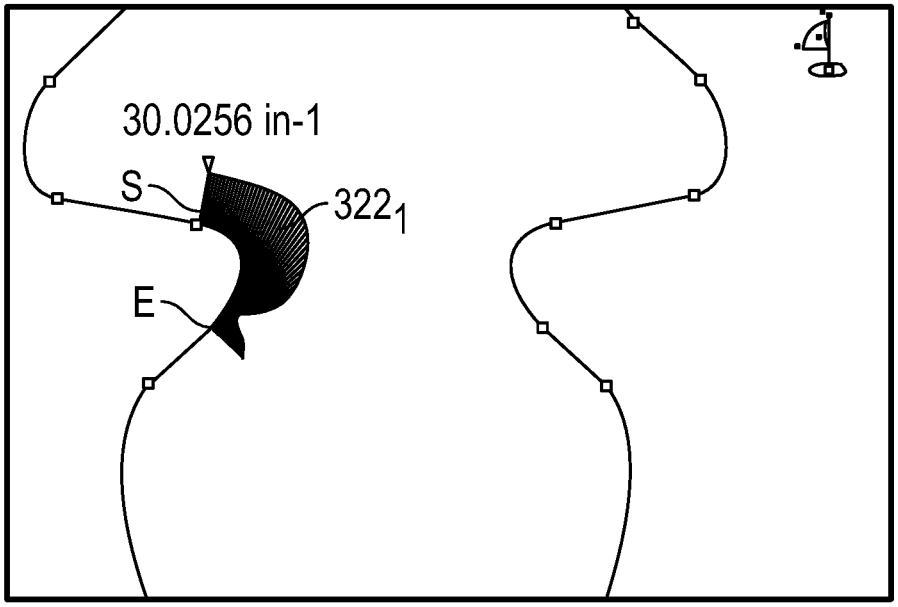
FIG. 6 is a graphical depiction of curvature (1/radii) of a portion of a spline profile of a fir tree structure in accordance with embodiments.
Figure 7:
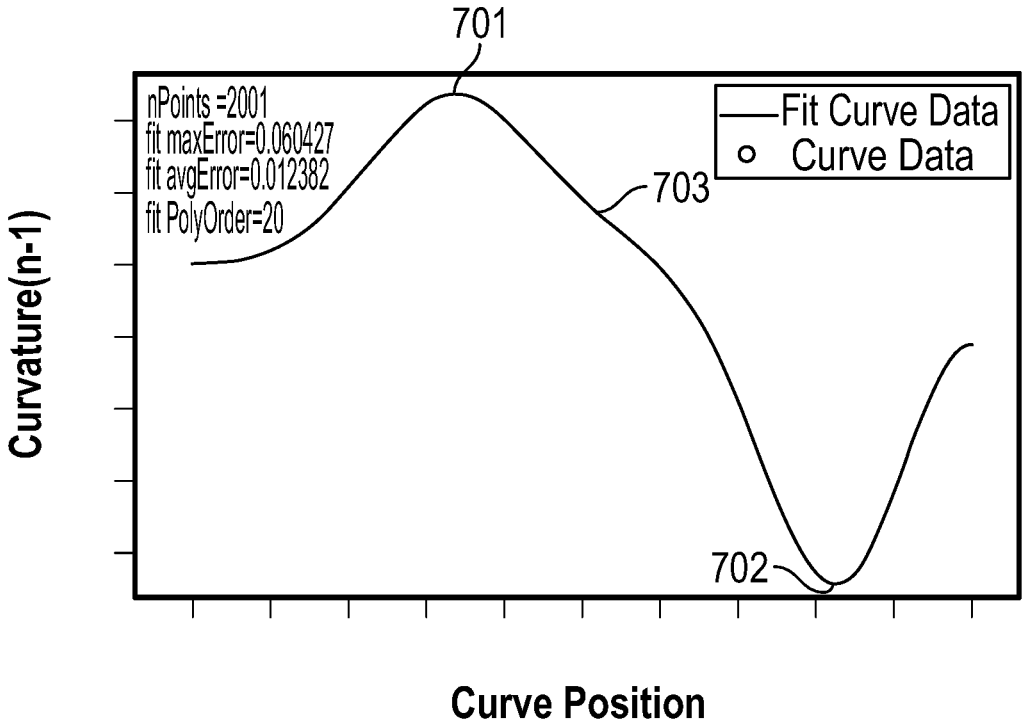
FIG. 7 is a plot of the curvature (1/radii) of FIG. 6 in accordance with embodiments.

As, shown in FIGS. 6 and 7, a plot of curvature, or the inverse of the radii, along the inboard blade fixing neck $\mathbf{322}_1$ exhibits a hump 701 and a trough 702. This plot can be taken from a starting point S at an outboard portion of the inboard blade fixing neck $\mathbf{322}_1$ to an ending point E at an inboard portion of the inboard blade fixing neck $\mathbf{322}_1$. In accordance with embodiments, there can be an inflexion point 703 between the hump 701 and the trough 702 but closer to the hump 701.

As shown in FIGS. 4, 5, 6, and 7, there can generally be a low amplitude plot of curvature in a neck of a fir tree structure in relative close proximity to blade and disc fir tree contact surfaces. This is due to bending and shear forces, which potentially increase fir tree neck stresses.

Figure 8:
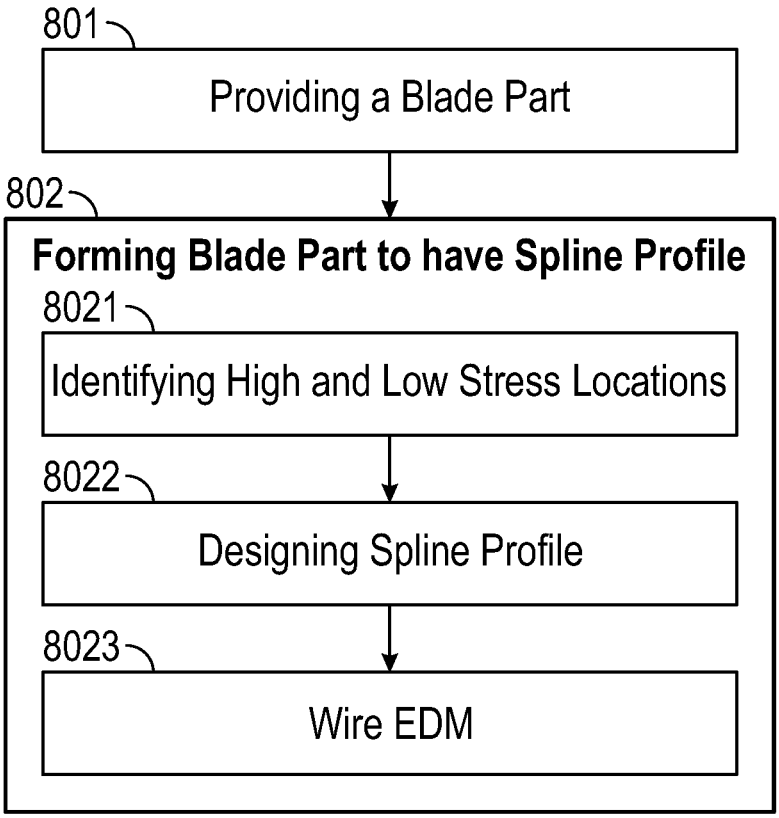
FIG. 8 is a flow diagram illustrating a method of forming a fir tree structure in accordance with embodiments.

With references to FIG. 8, a method of forming a fir tree structure of a turbine blade is provided and includes providing a blade part extending radially inwardly from the turbine blade and having an inward taper (801) and forming the blade part to have a spline profile forming blade fixing lobes and blade fixing necks, which are interleaved with the blade fixing lobes (802). The forming of the blade part of 602 includes identifying high and low stress locations of the blade part (6021) and designing the spline profile to have constantly changing radii of curvature characterized in that the radii of curvature are relatively reduced in the high stress locations and relatively increased in the low stress locations (8022). The forming of the blade part of 602 can include machining (8023) or another similar process.

Technical effects and benefits of the present disclosure are the provision of a fir tree structure of a turbine blade that is provided with varying spline profiles. This is enabled by machining and other similar processes. The varying spline profiles result in the fir tree structure being optimized for stress across varying operational ranges.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the technical concepts in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

While the preferred embodiments to the disclosure have been described, it will be understood that those skilled in the art, both now and in the future, may make various improvements and enhancements which fall within the scope of the claims which follow. These claims should be construed to maintain the proper protection for the disclosure first described.

What is claimed is:

1. A fir tree structure, comprising:

a part extending radially inwardly from a rotating part and having an inward taper, the part having a spline profile, the spline profile comprising:

blade fixing lobes; and blade fixing necks which are interleaved with the blade fixing lobes, the spline profile having constantly changing radii of curvature at the blade fixing lobes and at the blade fixing necks wherein the constantly changing radii of curvature are characterized in that the radii of curvature are relatively reduced in high stress locations and relatively increased in low stress locations.

2. The fir tree structure according to claim 1, wherein:

the blade fixing lobes comprise an inboard blade fixing lobe and an outboard blade fixing lobe, which is wider than the inboard blade fixing lobe, and the blade fixing necks comprise an inboard blade fixing neck, which is inboard from the outboard blade fixing lobe, and an outboard blade fixing neck, which is outboard of the outboard blade fixing lobe and wider than the inboard blade fixing neck.

3. The fir tree structure according to claim 2, wherein the spline profile comprises non-curvature portions at transitions between the blade fixing lobes and the blade fixing necks.

4. The fir tree structure according to claim 2, wherein a plot of curvature along the outboard blade fixing neck exhibits a first hump, a second hump of significantly greater amplitude than the first hump and a third hump of slightly greater amplitude than the second hump.

5. The fir tree structure according to claim 4, wherein the plot of the curvature along the outboard blade fixing neck is taken from a starting point at an outboard portion of the outboard blade fixing neck to an ending point at an inboard portion of the outboard blade fixing neck.

6. The fir tree structure according to claim 4, wherein the second hump is interposed between the first and third humps.

7. The fir tree structure according to claim 4, wherein the first, second and third humps have a similar pitch.

8. The fir tree structure according to claim 2, wherein a plot of curvature along the inboard blade fixing neck exhibits a hump, a trough and an inflexion point between the hump and the trough that is closer to the hump.

9. The fir tree structure according to claim 8, wherein the plot of the curvature along the outboard blade fixing neck is taken from a starting point at an outboard portion of the inboard blade fixing neck to an ending point at an inboard portion of the inboard blade fixing neck.

10. A fir tree structure of a turbine blade, comprising:

a blade part extending radially inwardly from the turbine blade and having an inward taper, the blade part having a spline profile, the spline profile comprising:

blade fixing lobes;

blade fixing necks which are interleaved with the blade fixing lobes; and non-curvature portions at transitions respectively defined between each of the blade fixing lobes and each neighboring ones of the blade fixing necks, the spline profile having constantly changing radii of curvature at the blade fixing lobes and at the blade fixing necks wherein the constantly changing radii of curvature are characterized in that the radii of curvature are relatively reduced in high stress locations and relatively increased in low stress locations.

11. The fir tree structure according to claim 10, wherein:

the blade fixing lobes comprise an inboard blade fixing lobe and an outboard blade fixing lobe, which is wider than the inboard blade fixing lobe, and the blade fixing necks comprise an inboard blade fixing neck, which is inboard from the outboard blade fixing lobe, and an outboard blade fixing neck, which is outboard of the outboard blade fixing lobe and wider than the inboard blade fixing neck.

12. The fir tree structure according to claim 11, wherein a plot of curvature along the outboard blade fixing neck exhibits a first hump, a second hump of significantly greater amplitude than the first hump and a third hump of slightly greater amplitude than the second hump.

13. The fir tree structure according to claim 12, wherein the plot of the curvature along the outboard blade fixing neck is taken from a starting point at an outboard portion of the outboard blade fixing neck to an ending point at an inboard portion of the outboard blade fixing neck.

14. The fir tree structure according to claim 12, wherein the second hump is interposed between the first and third humps.

15. The fir tree structure according to claim 12, wherein the first, second and third humps have a similar pitch.

16. The fir tree structure according to claim 11, wherein a plot of curvature along the inboard blade fixing neck exhibits a hump, a trough and an inflexion point between the hump and the trough that is closer to the hump.

17. The fir tree structure according to claim 16, wherein the plot of the curvature along the outboard blade fixing neck is taken from a starting point at an outboard portion of the inboard blade fixing neck to an ending point at an inboard portion of the inboard blade fixing neck.

18. A method of forming a fir tree structure of a turbine blade, the method comprising:

providing a part extending radially inwardly from the turbine blade and having an inward taper; and forming the part to have a spline profile, the forming of the part comprising:

identifying high and low stress locations of the part; and designing the spline profile to comprise:

blade fixing lobes; and blade fixing necks which are interleaved with the blade fixing lobes;

and further designing the spline profile to have constantly changing radii of curvature at the blade fixing lobes and the blade fixing necks wherein the constantly changing radii of curvature are characterized in that the radii of curvature are relatively reduced in the high stress locations and relatively increased in the low stress locations.

19. The method according to claim 18, wherein the part comprises a blade part.

* * * * *